US005233859A

United States Patent [19]

Sbrana

[11] Patent Number: 5,233,859

[45] Date of Patent: * Aug. 10, 1993

[54] PROCESS FOR THE PREPARATION OF TUBULAR INGOT MOULDS INTENDED FOR INSTALLATIONS FOR THE CONTINUOUS CASTING OF STEEL

[75] Inventor: Armando Sbrana, Tirrenia, Italy

[73] Assignee: Europa Metalli-LMI S.p.A., Florence, Italy

[ * ] Notice: The portion of the term of this patent subsequent to Aug. 11, 2007 has been disclaimed.

[21] Appl. No.: 854,226

[22] Filed: Mar. 20, 1992

Related U.S. Application Data

[63] Continuation of Ser. No. 624,037, Dec. 7, 1990, Pat. No. 5,136,872.

[51] Int. Cl.[5] ..... B21K 21/08

[52] U.S. Cl. ..... 72/370

[58] Field of Search ..... 72/283, 284, 370, 391.2

[56] References Cited

U.S. PATENT DOCUMENTS 693,119 2/1902 Diescher ..... 72/283

718,671 1/1903 Stiefel et al. ..... 72/283

4,653,306 3/1987 Lazzerini ..... 72/283

*Primary Examiner*—Lowell A. Larson

*Attorney, Agent, or Firm*—Michael N. Meller

[57] ABSTRACT

The process serves for the preparation of tubular copper or copper alloy chills or ingot moulds for use in continuous steel casting system, including a first stage comprising the formation of an inclined shoulder on one end of a tubular blank having a rectilinear axis, by cold plastic deformation; a second stage comprising shaping the said blank in such a way as to impart to it a curved form; a third stage comprising subsequently introducing into the interior of the blank a mandrel having external shape and dimensions equal to those of the chill which it is desired to obtained; a fourth stage comprising passing the blank through a die of a drawplate having dimensions such as to deform the material of the blank to cause the internal surface of the blank to adhere strictly to the external surface of the mandrel; a fifth stage performed when the blank has traversed the die, comprising exerting a substantially axial force on the mandrel in the opposite direction from that exerted in the preceding stage, whilst one end of the blank is engaged on abutment sectors disposed beneath the die.

3 Claims, 4 Drawing Sheets

11
12
G
15
16
17
18
19
20
21
22
3
101
120

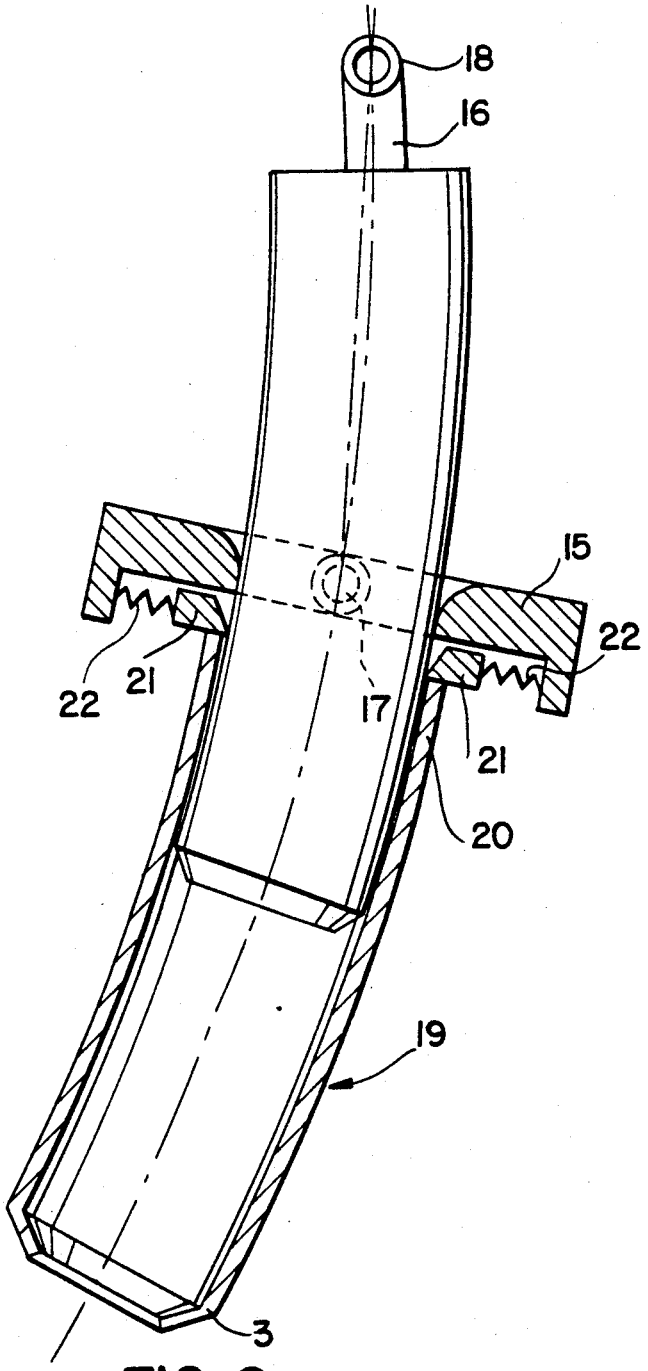
FIG. 9
FIG. 10
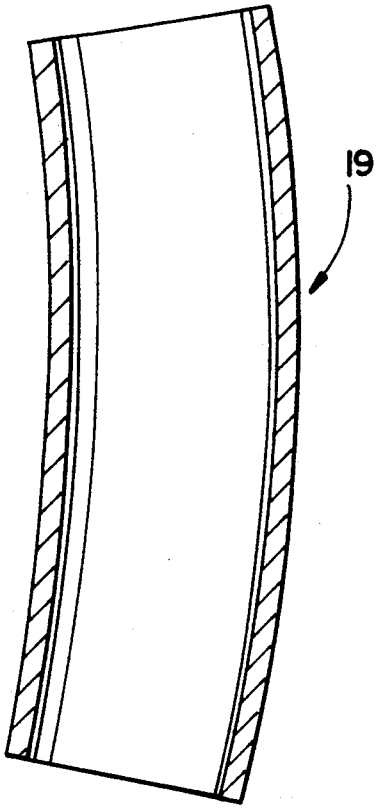

PROCESS FOR THE PREPARATION OF TUBULAR INGOT MOULDS INTENDED FOR INSTALLATIONS FOR THE CONTINUOUS CASTING OF STEEL

This is a continuation, of application Ser. No. 624,037 filed Dec. 7, 1990, now U.S. Pat. No. 5,136,872 issued Aug. 11, 1992.

BACKGROUND OF THE INVENTION

The present invention relates to a process for the preparation of tubular chills (also called ingot moulds) of copper or copper alloys of the type shaped in such a way as to have a substantially curved longitudinal axis and intended for installations for the continuous casting of steel.

In an installation for the continuous casting of steel, as is known, the said chills are traversed by a flow of molten metal, which commences its solidification whilst traversing these, under the action of a vigorous cooling achieved by the circulation of a coolant fluid which flows over the outer surface of the chills themselves.

In order to perform effectively the functions which are required of them chills of this type must have a complex set of favourable properties. First of all they must be provided with internal surfaces having a very high surface hardness and a finish such as to allow the deposition thereon of a layer of cladding material (for example chrome) able to resist effectively the wear action caused by the sliding of the molten steel, as well as allowing this sliding to take place with low friction; in the second place, the cross-section of the chill must decrease slightly along its axis (conical profile) in such a way as to ensure always a perfect transmission of heat towards the coolant means which flow over the outer surface of the chill: it has in fact been found that, whenever such a reduction in cross-section along the axis is not present, because of the shrinkage of the material which solidifies in correspondence with its outer layers, it is possible for the metal to become separated from the internal surface of the chill which considerably reduces the coefficient of transmission of heat between the metal and the chill itself.

For the preparation of chills of the above-indicated type it is normal to start with a blank of tubular form having a rectilinear axis obtained simply by drawing or by any other operation. Subsequently a curved form is imparted to it, normally by exerting radial pressures on its outer surface by means of a die of suitable form; subsequently, for the purpose of creating the desired surface finish and the variation in cross-section along the axis necessary for achieving the correct flow of steel along the chill itself, the internal surface of the curved blank is worked by material-removing operations such as grinding or lapping, or else in an alternative process by progressive chemical attack differentiated in depth along the axis of the blank. Chills obtained in the manner described have numerous disadvantages consisting principally in a poor surface durability of the internal surface of the chill and in a poor surface finish thereof; moreover, both the mechanical working and the process of chemical attack necessary to achieve the conical internal surface of the ingot mould are rather lengthy and complex operations.

For the purpose of overcoming these disadvantages Italian Patent No 1,160,132 in the name of the same applicant describes a process in which an ingot mould or chill is formed to the required size using only plastic deformation operations thanks to the introduction, within a previously bent blank, of a curved mandrel having externally the final form of the ingot mould which it is desired to obtain and a subsequent drawing operation effected on the assembly of elements constituted by the blank with the said curved mandrel housed within it.

However, even this process is not entirely free of disadvantages; in particular, especially when it is necessary to obtain ingot moulds of rather great length, this known process does not allow the dimensional precision and required form to be obtained both because of the difficulty of centring the mandrel within the curved blank and because of problems of elastic instability of the blank during a stage before the drawing stage and in which the blank is provided with an axial shoulder which subsequently serves as an abutment for the mandrel during the drawing stage.

SUMMARY OF THE INVENTION

The object of the invention is that of providing a process for the preparation of chills or ingot moulds of the type described, which allows all the disadvantages connected with the known processes to be eliminated.

The said object is achieved by the invention, which relates to a process for the preparation of tubular chills or ingot moulds in copper or copper alloy shaped in such a way as to have a substantially curved longitudinal axis and intended for installations for the continuous casting of steel, characterised by the fact that it comprises:

a first stage comprising turning a first end of a tubular blank having a rectilinear axis, by means of cold plastic deformation, in such a way as to form an inclined annular shoulder at this end coaxial with a longitudinal axis of symmetry of the said tubular blank;

a second stage comprising shaping the said blank in such a way as to impart to it a curved shape in which its longitudinal axis assumes a substantially arcuate shape, the said second stage being effected by means of the application, in a mould, of pressures on the outer surface of the blank directed substantially in a direction orthogonal to the said axis of the blank;

a third stage comprising introducing into the interior of the said blank, with a predetermined and relatively wide radial play, a mandrel having external shape and dimensions corresponding to the internal dimensions of the chill which it is desired to obtain, and by causing a first end of the mandrel to cooperate and abut against the said inclined annular shoulder;

a fourth stage in which the said blank is caused to pass through a die of a drawplate having dimensions such as to deform the material of the said blank to cause the internal surface of the blank itself to adhere strictly to the outer surface of the said mandrel, the said fourth stage being effected by exerting a substantially axial force on the said mandrel in such a way as to transmit the said force to the blank by means of the abutment of the mandrel on the said inclined annular shoulder;

a fifth stage comprising exerting, when the said blank has traversed the said drawplate, a substantially axial force on the said mandrel having a direction opposite that of the force exerted in the preceding stage, whilst one end of the said blank, opposite the said inclined annular shoulder, is caused to abut on respective abutment sectors disposed beneath the said drawplate.

BRIEF DESCRIPTION OF THE DRAWINGS

For a better understanding of the process of the present invention the fundamental stages thereof are now described by way of non-limitative example, with reference to the attached drawings, in which:

FIGS. 1, 4 and 10 represent blanks utilised, or obtained, in the course of the process according to the invention;

FIGS. 2, 3, 5, 6, 7, 8 and 9 schematically represent successive stages in the process of the invention.

DETAILED DESCRIPTION OF THE INVENTION

Figure 11:
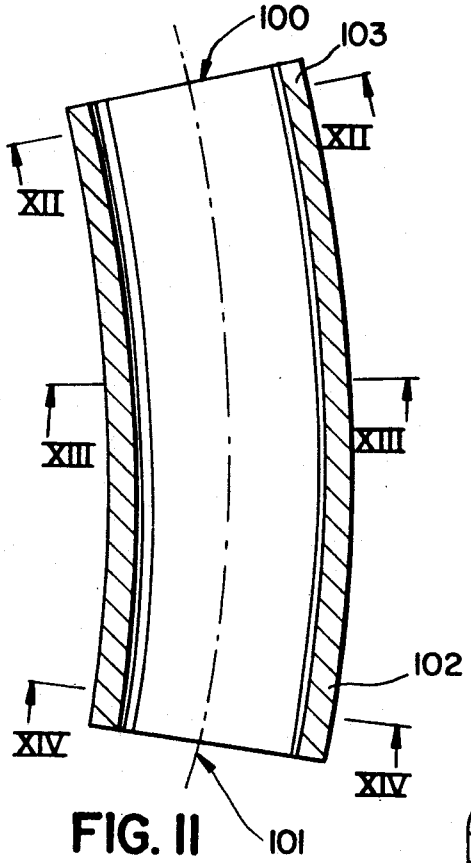

A chill or ingot mould usable in installations for continuous steel casting, and obtained with the process of the present invention, is shown in FIGS. from 11 to 14 where it is generally indicated with the reference numeral 100. The chill 100 has substantially the shape of a tubular element with a curved longitudinal axis of symmetry 101, for example shaped as an arc of a circle (FIG. 11) and has an internal cross-section which progressively decreases along the said axis, in such a way as to present an internal taper or cone shape along the axis 101 starting from its end 102 of greater cross-sectional area and extending towards the opposite end 103 which has a smaller internal cross-section than that of the end 102; the shape of the cross-section of the chill or ingot mould 100 can be any suitable shape, and preferably is square as is shown in the drawings.

Figure 1:
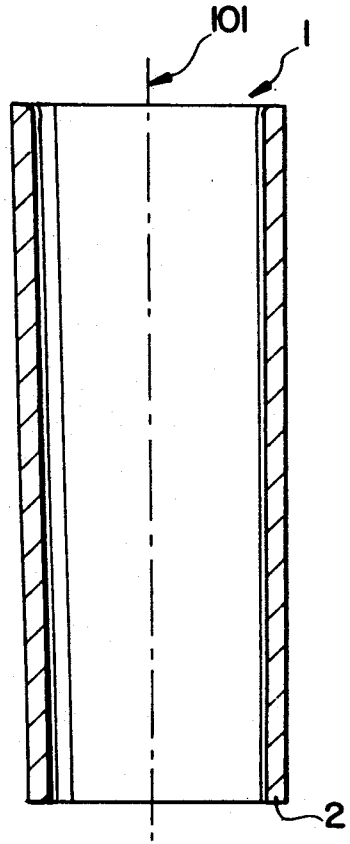

The process of the invention is performed starting with a blank 1 of tubular form having a rectilinear axis, of the type shown in FIG. 1; this blank 1 is made of copper or one of its alloys, for example by simple extrusion or by any other suitable method, and has a rectilinear longitudinal axis of symmetry again indicated 101, in that it will become, as will be seen hereinbelow, the axis of the ingot mould or chill 100.

Figure 4:
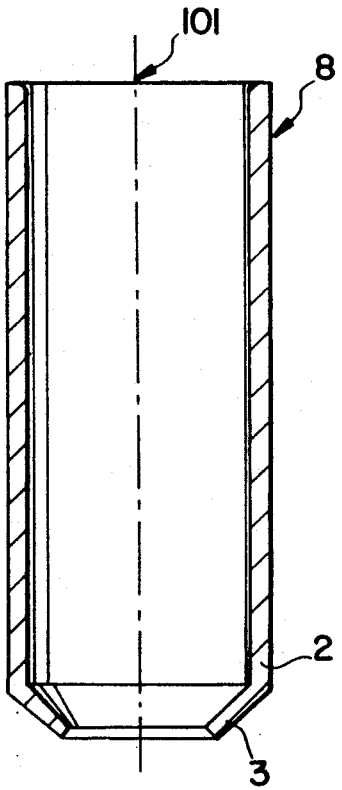

The process includes a first stage for turning over one end 2 of the blank 1 by cold plastic deformation in such a way as to form at this end an inclined annular shoulder 3 which is perfectly coaxial with the axis 101 as has been shown in FIG. 4 which illustrates a blank obtained at the end of the first stage.

Figure 2:
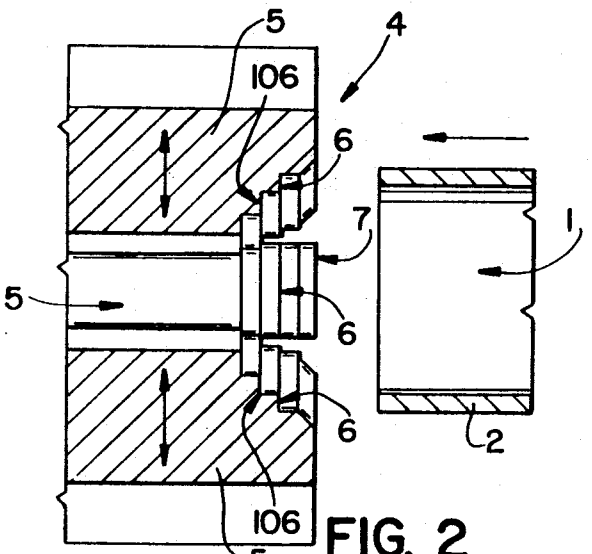
Figure 3:
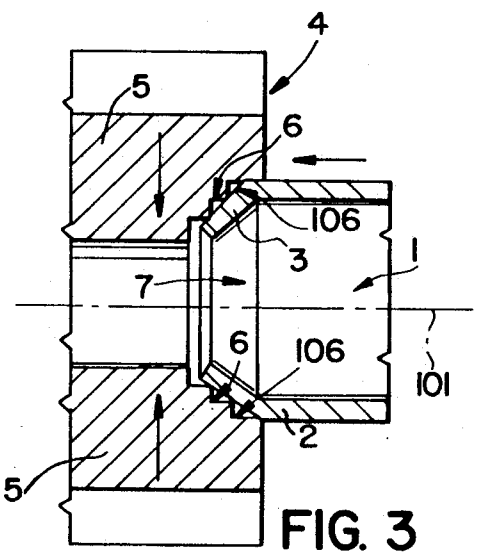

According to a principal characteristic of the process according to the invention, this first cold plastic deformation stage is performed by the operations which are schematically shown in FIGS. 2 and 3. With reference to these Figures, the formation of the inclined shoulder 3 is effected by mean of a point-former device 4 comprising a plurality of sectors or "mouths" 5 shaped as circular sectors and mounted so as to be radially movable, for example under the control of suitable hydraulic actuators (known and not illustrated for simplicity) on an annular support structure (also not illustrated for simplicity) on which they are disposed adjacent one another with a constant separation in a circular ring to define, with respective corresponding inclined and radially inner working surfaces thereof, indicated 6, a tapered cavity 7 inclined towards its bottom and of variable width; the rectilinear blank 1 is disposed coaxially with the conical cavity 7 and after separation to the maximum possible dimensions thereof its end 2 is introduced into the interior of the device 4 just into the cavity 7; then, on the ends 2 of the blank 1 there are exerted simultaneous radial and axial compression stresses obtained by clamping the end 2 between the sectors 5 and displacing these latter progressively towards the axis 101 in the direction of the arrow (FIG. 3) simultaneously all by the same amount in such a way as to obtain progressive reduction in the dimensions of the cavity 7 and, simultaneously, axially forcing the blank 1 against the sectors 5, in particular against the inclined working surfaces 6, in the direction of the arrow and with an axial force just sufficient to maintain the element 2 constantly in contact with the surfaces 6 in such a way as to balance the axial stress component which these latter transmit to the blank 1 as a consequence of the centripedal radial displacement, towards the axis 101, of the sectors 5; in this way the end 2 is plastically deformed tapering it in cross-section and thickness and elongating it. So as to encourage the grip of the sectors 5 on the end 2 of the blank 1 the inclined working surfaces 6 of the device 4 are each provided with a plurality of steps 106 which, in FIGS. 2 and 3, are represented on a very much enlarged scale with respect to reality, so as to increase the friction between the sectors 5 and the blank 1. At the end of this first stage of the process a blank 8 is obtained, which is shown in FIG. 4 and which, in the specific example illustrated, the starting blank 1 having a square cross-section, has an annular inclined shoulder 3 of substantially frusto-pyramid form.

Figure 5:
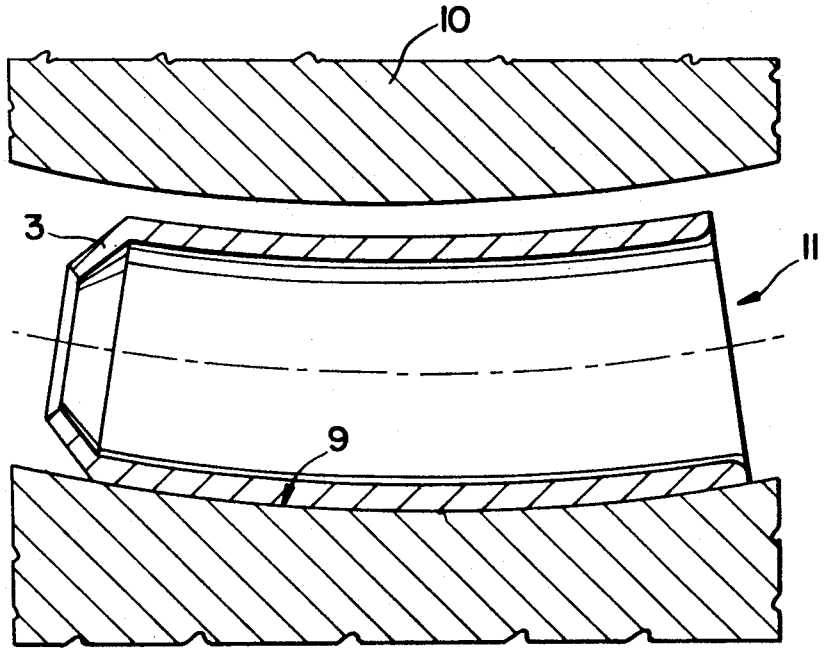

The process of the invention then includes a second stage for shaping the blank 8 in such a way as to impart to it a curved form in which its longitudinal axis assumes a shape, for example an arc of a circle; this stage, as is clearly seen in FIG. 5, is performed by exerting substantially radial pressures on the outer surface of the blank 8; these pressures can be effectively exerted by means of a die substantially comprising a concavely curved engagement surface 9, and a movable part 10 adapted to be displaced towards it and also curved, but convexly.

Figures 6, 7, 8:
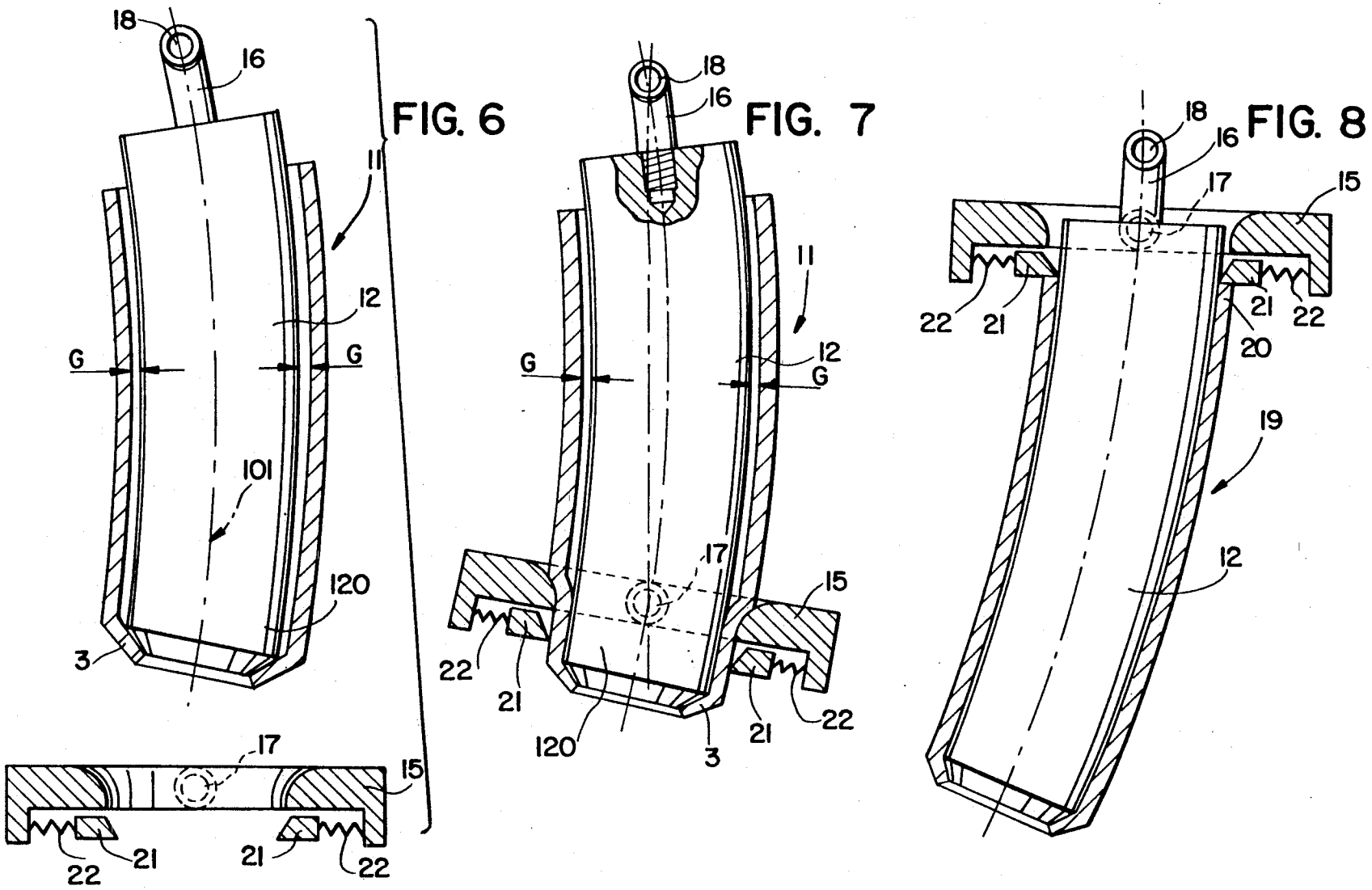

In a third stage of the process according to the invention a mandrel 12 is introduced into the blank 11 thus obtained, the mandrel 12 having an external shape and dimensions equal to the internal dimensions of the chill which it is desired to obtain; in this stage a lower end 120 of the mandrel 12 is caused to engage against the inclined annular shoulder 3 as it clearly seen in FIG. 6. The internal dimensions of the blank 1 shown in FIG. 1, which starts with a rectilinear axis, are chosen in such a way that the internal dimensions of the partly finished product 11 utilised in this third stage are greater than the maximum dimensions of the mandrel 12 in such a way as to leave between the mandrel 12 and the partly finished product 11 a predetermined radial clearance G which is substantially constant at all points; according to the invention this clearance G must be rather great, for example of the order of several millimeters or more, and must be maintained substantially constant over the whole of the internal surface of the partly finished product 11 and the outer surface of the mandrel 12; the constancy of the clearance G, as well as the perfect coaxial alignment between the mandrel 12 and the partly finished product 11 is obtained, according to the invention, thanks to the inclined form of the annular shoulder 3 which defines a frusto-conical entrance, in the specific example illustrated a frusto-pyramid entrance, for the mandrel 12 which can thus be self-centring with respect to the partly finished blank 11; the mandrel 12, according to the invention, also has the same curvature of its longitudinal axis which it is desired to impart to the axis 101 of the ingot mould to be obtained and is tapered towards its end 120.

The assembly constituted by the partly finished blank 11 and the mandrel 12 disposed within it with clearance and maintained centred in it by the self-centring action of the inclined shoulder 3 is caused to pass, in a fourth stage of the process, through a die 15 (FIG. 7) of a drawplate, otherwise of known type, having dimensions such as to deform the material of the partly finished blank itself and to press the internal surface of this tightly against the outer surface of the mandrel. In particular the internal dimensions of the die 15 are equal to the external dimensions of the ingot mould which it is desired to obtain and are close to the internal dimensions of the partly finished blank 11, thus producing, during the performance of this stage, the elimination of the clearance G with consequent squeezing and elongation of the blank 11 against the mandrel 12.

The said stage is effected by exerting a substantially axial force on the mandrel 12 in such a way as to transmit the force itself to the blank 11 by the engagement of the mandrel 12 on the annular shoulder 3. As is seen from the diagram of FIG. 7, during the said fourth stage an upper end 16 of the mandrel 12, opposite the lower end 120, is caused to oscillate in the plane which contains the arcuate longitudinal axis of the mandrel 12 and which substantially coincides with the axis 101 of the blank 11, whilst the die 15 is also oscillated in the same plane about an axis the line of which has been indicated 17. This is obtained, for example, by means of articulated joints of known type disposed in coincidence with these axes.

During the said stage, because of the reduction in the dimensions of the cross-section of the partly finished blank 11 whilst it traverses the die 15, as well as causing the internal surface thereof to assume the outer shape of the mandrel, there is also caused a considerable work hardening of the material of the surface itself, which confers on it a considerable hardness and therefore a high resistance to wear. It has been established that when the drawing operation which is effected in this fourth stage has taken place in the presence of rather high clearances between the mandrel 12 and the partly finished blank 11, as previously indicated, the internal surface of the blank rigorously assumes the shape of the outer surface of the mandrel 12, the axis 101 is coincident with the longitudinal axis of the mandrel 12 and, simultaneously, the material of the internal surface of the blank assumes a very great hardness. In fact, only in the presence of these very wide clearances the material of the blank 11, to pass from the initial configuration to the final shape is subjected to radial and axial displacements of a considerable magnitude produced by the action of the radial and axial pressures exerted by the opening of the die on the outer surface of the blank being worked. In FIG. 8 is shown the assembly of blank and mandrel at the end of the said fourth stage.

It has also been found that to obtain these results it is essential that the clearance G be uniformly distributed between the mandrel 12 and the blank 11, that is to say that this latter be perfectly coaxial with the mandrel 12 and this, in the process of the invention, is obtained thanks to the self-centring action of the inclined shoulder 3.

The process further includes a fifth stage, performed when the blank 11 has traversed the die 15, for exerting a substantially axial force on the mandrel 12 in a sense opposite that of the force exerted in the preceding stage; during this stage an end 20 of the blank is caused to engage on respective abutment sectors 21 disposed beneath the die 15 and movable towards the mandrel 12. It is therefore evident that, by the action of the indicated force, the mandrel 12 can be withdrawn from the blank 19 in a rapid and simple matter in that this is held in a fixed position by the action of the sectors 21. Conveniently these latter can be controlled by actuator means adapted to function in an entirely automatic manner, for example by springs 22 (FIG. 9).

To obtain the finished chills it is sufficient, at this point, to cut an end section from the blank 19 whereby to eliminate the shoulder 3, as has been shown in FIG. 10, and to subject this to further known treatments, in particular to the deposition of a layer of cladding material on its internal surface (grooming treatment or the like).

The chill or ingot mould thus obtained has numerous favourable properties. First of all the shape of its internal surface is rigorously defined; this is due to the perfect copying action between the mandrel 12 and the blank 11 formed in the fourth stage of the process (FIG. 7); this favourable characteristic is due both to the presence of the clearances G regularly distributed between the mandrel 12 and the blank 11, which induce movements of the material of the blank itself, and to 'the perfect coaxiality between the mandrel 12 and the blank 11, as well as to the correct drawing action which can be effected on the blank 11 by the action of the mandrel 12; all these characteristics are obtained according to the invention thanks to the presence of an inclined annular shoulder 3 and, moreover, to the constraint conditions of the mandrel 12 and the die 15, which can oscillate respectively about the axes 18 and 17 (FIG. 7).

Figure 12:
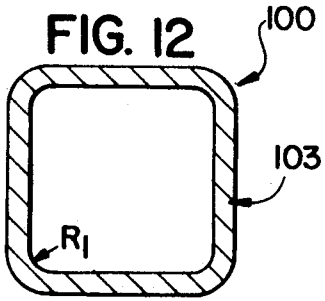
FIGS. 11, 12, 13 and 14 respectively represent a longitudinal section and transverse sections of the chill or ingot mould obtained with the process according to the invention.
Figure 13:
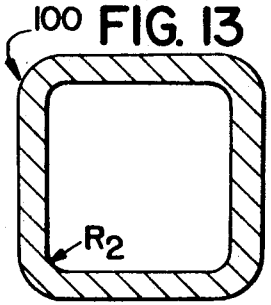
Figure 14:
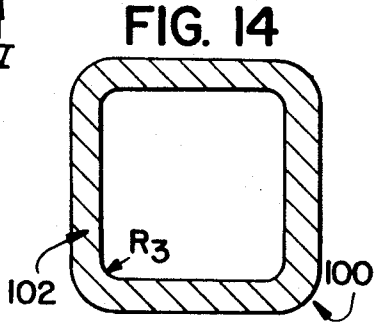

Moreover, because of the said drawing action, the internal surface of the chill acquires a surface hardness and is put into a condition suitable to receive a layer of cladding material which presents high resistance to wear. Finally, thanks to the tapering of the mandrel a variation according to a desired law of the internal section of the chill along its longitudinal axis can be achieved directly during the drawing, this section gradually reducing as shown in the cross-sections of FIGS. 12, 13 and 14. In particular, the radii of the corners indicated R1, R2 and R3 between the sides of the sections themselves, can also be gradually decreasing to achieve the optimum conditions for the passage of molten steel within the chill 100.

Finally, it is evident that the described stages of the present process can have modifications and variations introduced to them without by this departing from the ambit of the invention.

I claim:

1. A process for the preparation of tubular chills or ingot moulds in copper or copper alloys shaped to have a substantially curved longitudinal axis and intended for continuous steel casting installations, the process comprises:

a first stage comprising turning over a first end of a tubular blank having a rectilinear axis, by cold plastic deformation, to form, at said first end, an axial shoulder;

a second stage comprising shaping said blank to impart to it a curved form, in which its longitudinal axis assumes a substantially arcuate shape, said second stage being effected by the application in a mould of pressures onto the external surface of said blank directed in a direction substantially orthogonal to said axis of said blank;

a third stage comprising introducing into said blank, with a predetermined relatively wide radial clearance, a mandrel having external shape and dimensions equal to the internal shape and dimensions of the chill which it is desired to obtain and engaging a first end of said mandrel against said axial shoulder;

a fourth stage comprising passing said blank through a die of a drawplate having dimensions to deform the materials of said blank to cause the inner surface of said blank to conform strictly with the outer surface of said mandrel, said fourth stage being effected by exerting a substantially axial force on said mandrel to transmit said force to said blank by the engagement of said mandrel on said axial shoulder; and a fifth stage performed when said blank has traversed said die, comprising exerting a substantially axial force on said mandrel in a direction opposite to that of the force exerted in said fourth stage, whilst an end of said blank, opposite said axial shoulder, is engaged on respective abutment sectors disposed beneath said die; whereby said axial shoulder is formed as an annular element, inclined with respect to the longitudinal axis of symmetry of said tubular blank at an angle different from 90° so as to define a tapered hollow end in said blank able to receive in a self-centering manner said end of said mandrel coaxial with said axis of said blank.

2. A process according to claim 1, wherein said internal dimensions of the said blank are chosen in such a way as to be greater than the maximum dimensions of the said mandrel to leave between the mandrel and the blank a predetermined radial clearance (G) which is substantially identical at all points.

3. A process according to claim 1, wherein whilst the said force is exerted during the said fourth stage, a second end of the mandrel opposite the said first end is maintained in oscillation in the plane which contains the arcuate axis of the said mandrel, whilst the said die is also oscillated in the same plane.

* * * * *